US010498047B1

(12) United States Patent
McGough et al.

(10) Patent No.: US 10,498,047 B1
(45) Date of Patent: Dec. 3, 2019

(54) CAPACITIVELY-COUPLED DUAL-BAND ANTENNA

(71) Applicant: PC-TEL, Inc., Bloomingdale, IL (US)

(72) Inventors: Erin McGough, Cuyahoga Falls, OH (US); Scott Lindner, Hudson, OH (US); Thomas Lutman, Berlin Center, OH (US); Stephen Saliga, Akron, OH (US)

(73) Assignee: PC-TEL, INC., Bloomingdale, IL (US)

( * ) Notice: Subject to any disclaimer, the term of this patent is extended or adjusted under 35 U.S.C. 154(b) by 0 days.

(21) Appl. No.: 15/962,064

(22) Filed: Apr. 25, 2018

Related U.S. Application Data

(60) Provisional application No. 62/560,990, filed on Sep. 20, 2017.

(51) Int. Cl.
*H01Q 21/30* (2006.01)
*H01Q 5/378* (2015.01)
*H01Q 9/04* (2006.01)

(52) U.S. Cl.
CPC ..... *H01Q 21/30* (2013.01); *H01Q 5/378* (2015.01); *H01Q 9/0464* (2013.01)

(58) Field of Classification Search
CPC ..... H01Q 1/22; H01Q 1/2291; H01Q 5/378; H01Q 9/0457; H01Q 9/0464; H01Q 9/36; H01Q 21/30
See application file for complete search history.

(56) References Cited

U.S. PATENT DOCUMENTS 8,963,793 B2 2/2015 Saliga et al.
2003/0103008 A1* 6/2003 Petropoulos ..... H01Q 1/243 343/702

(Continued)

FOREIGN PATENT DOCUMENTS

EP 3 166 178 A1 5/2017
WO 2012/144247 A1 10/2012

OTHER PUBLICATIONS

Extended European search report for corresponding EP patent application 18194873.8, dated Feb. 13, 2019.

(Continued)

*Primary Examiner* — Hoang V Nguyen
(74) *Attorney, Agent, or Firm* — Husch Blackwell LLP

(57) ABSTRACT

A robust, dual-band, omnidirectional antenna is provided. In some embodiments, the antenna can be deployed in a Wi-Fi access point and tuned to operate with high efficiency in a plurality of driving point environments, and in some embodiments, the antenna can be tuned to operate with high efficiency over an impedance bandwidth in excess of 80% with little change to the radiation patterns. The antenna can operate in a $TM_{20}$ circular patch mode in a low frequency band and in a wideband quarter wavelength monopole mode in a high frequency band, and both the $TM_{20}$ circular patch mode and the quarter wavelength monopole mode can radiate a strongly circulating magnetic field that can beget excellent omnidirectional radiation patterns and decouple the antenna from nearby horizontally-polarized antenna elements, thereby allowing the antenna to be collocated with horizontally-polarized elements with little degradation to overall system level performance.

16 Claims, 7 Drawing Sheets

(56) References Cited

U.S. PATENT DOCUMENTS

| | | | | |
|---|---|---|---|---|
| 2003/0210193 | A1* | 11/2003 | Rossman | H01Q 9/0464 343/725 |
| 2008/0266181 | A1* | 10/2008 | Ying | H01Q 1/241 343/700 MS |
| 2017/0025750 | A1 | 1/2017 | Su et al. | |

OTHER PUBLICATIONS

J.-S. Row et al., Wideband Monopolar Square-Ring Patch Antenna, IEEE Transactions on Antennas and Propagation, vol. 54, No. 4, pp. 1335-1339, Apr. 2006.

Jing Zhao et al., Design Optimization of a Low-Profile UWB Body-of-Revolution Monopole Antenna, IEEE Transactions on Antennas and Propagation, vol. 60, No. 12, pp. 5578-5586, Dec. 1, 2012.

English language translation of WO patent publication 2012/144247 A1 dated Oct. 26, 2012.

* cited by examiner

CAPACITIVELY-COUPLED DUAL-BAND ANTENNA

CROSS-REFERENCE TO RELATED APPLICATIONS

This application claims priority to U.S. Provisional Patent Application No. 62/560,990 filed Sep. 20, 2017 and titled "CAPACITIVELY COUPLED DUAL BAND ANTENNA." U.S. Provisional Patent Application No. 62/560,990 is hereby incorporated herein by reference.

FIELD

The present invention relates generally to radio frequency (RF) communication hardware. In particular, the present invention relates to a capacitively-coupled dual-band antenna.

BACKGROUND

An ever increasing demand for greater bit capacity solutions drives the need to collocate a greater number of antennas within a single product housing or limited geographic area. As the number of collocated antennas increases, the number of possibilities with which the antennas may be mapped to one or more RF transceivers increases. Several different architectures are known. First, all of the collocated antennas may be connected to a single radio. Second, the collocated antennas may be divided between multiple radios operating in the same spectrum. Third, the collocated antennas may be divided between multiple radios operating in different frequency bands that are relatively close in frequency. Fourth, the collocated antennas may be divided between multiple radios operating in different frequency bands that are relatively far apart.

Some amount of antenna isolation (approximately 25 dB) is desired for each of the different architectures. However, each of the different architectures may have different requirements for antenna isolation to ensure desired system level performance, depending on how the collocated antennas are mapped to the transceiver(s). For example, the architecture that includes the collocated antennas divided between the multiple radios operating in the same spectrum requires the greatest antenna isolation between the collocated antennas connected to different radios because the different radios will otherwise inevitably interfere with one another.

When collocated antennas are divided between multiple radios, the most spatially effective and energy efficient way to achieve antenna isolation is to cross-polarize sets of antennas mapped to different radios. One set can be designed to radiate and receive vertically-polarized radiation, and another set can be designed to radiate and receive horizontally-polarized radiation. A greater polarization purity of antenna elements leads to a greater isolation between the sets of antennas.

Some antennas, such as the antenna disclosed in U.S. Pat. No. 8,963,793, are known in the art. However, known antennas with the above-identified architecture have at least two disadvantages. First, such known antennas include a complicated connection to a coaxial cable, including separate parts for feet or an eyelet, and a feed that is thermally tied to a substantial metal mass. Second, such known antennas are sensitive to radome loading at 2.4 GHz, thereby limiting products in which the antennas can reside.

In view of the above, there is a continuing, ongoing need for improved antennas.

DETAILED DESCRIPTION

Figure 1:
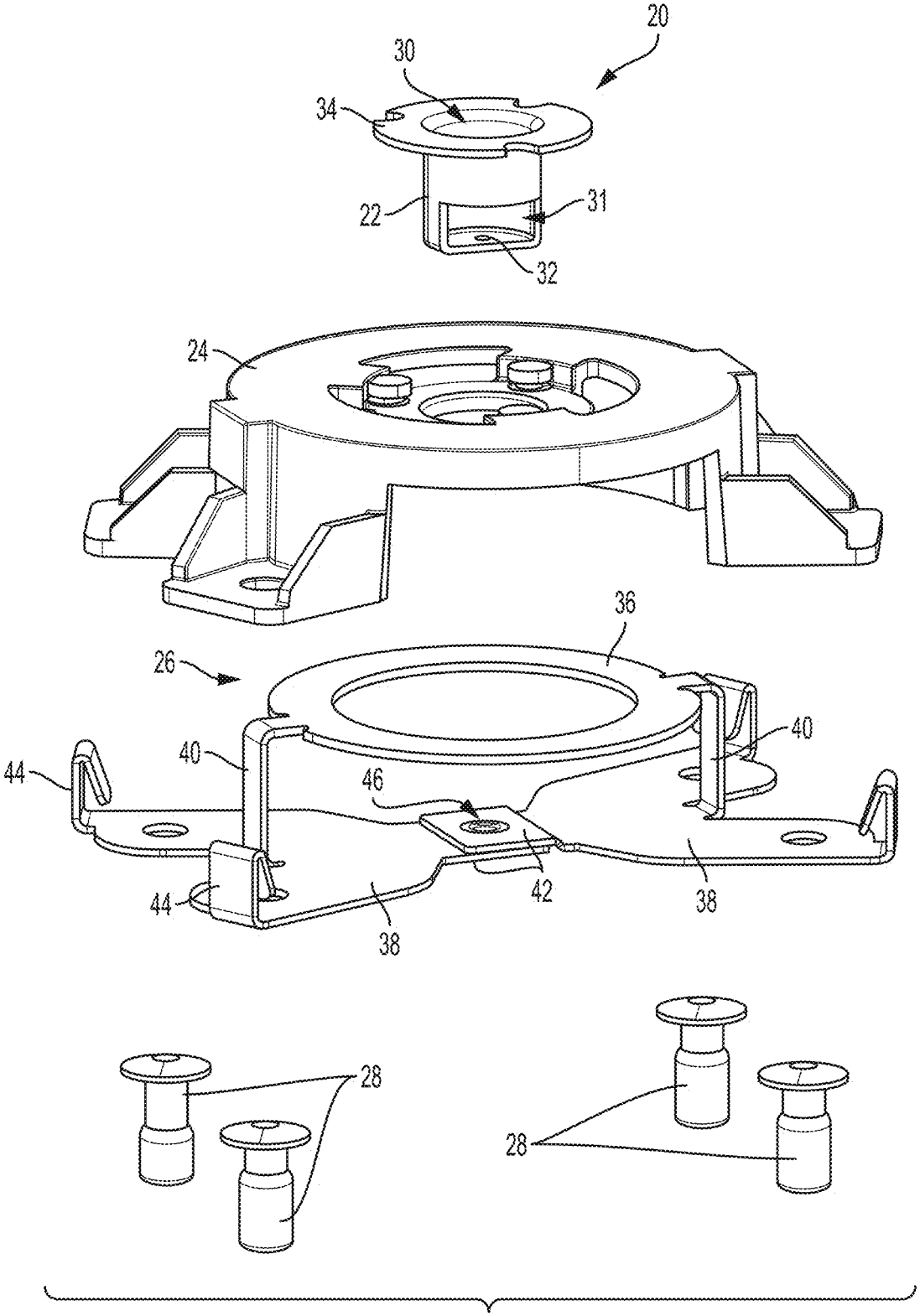
FIG. 1 is an exploded view of a capacitively-coupled dual-band antenna in accordance with disclosed embodiments and mounting hardware for the same.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include a capacitively-coupled dual-band antenna. For example, the capacitively-coupled dual-band antenna disclosed herein can include a hybrid antenna that combines a quarter wavelength monopole and a $TM_{20}$ mode circular patch antenna. Furthermore, in some embodiments, the capacitively-coupled dual-band antenna disclosed herein can include a strongly vertically-polarized omnidirectional antenna element that can be used and integrated in a ceiling-mounted multiple-input, multiple-output (MIMO) access point that includes both vertically-polarized and horizontally-polarized omnidirectional antenna elements having a low profile. Further still, in some embodiments, the strongly vertically-polarized omnidirectional antenna element can radiate a nearly pure vertical polarization in a plurality of directions in the azimuth plane and, therefore, can be well-isolated (at least 40 dB) from strongly horizontally-polarized antenna elements over a 5 GHz frequency band at a distance of at least 50 mm or 2 inches. One such horizontally-polarized antenna element is disclosed in U.S. application Ser. No. 15/944,950.

Advantageously, the capacitively-coupled dual-band antenna disclosed herein can achieve a high level of performance comparable to that achieved by the antenna disclosed in U.S. Pat. No. 8,963,793. However, the capacitively-coupled dual-band antenna disclosed herein can provide several additional advantages. First, the capacitively-coupled dual-band antenna disclosed herein can include a plastic carrier (non-conductive frame) that can improve the mechanical strength of the antenna. Second, the antenna design can obviate a need for an additional part for a ground feed tab or an eyelet to facilitate termination of a feed cable and can obviate a need for the feed cable being thermally tied to a substantial metal mass. Third, the capacitively-coupled dual-band antenna disclosed herein can include a window formed in a portion of the antenna to allow for a simple, straightforward connection of a center conductor of the feed cable to an interior surface of the antenna.

Advantageously, the capacitively-coupled dual-band antenna disclosed herein is not particularly sensitive to radome loading at 2.4 GHz or ground plane placement, thereby allowing the capacitively-coupled dual-band antenna to achieve a high level of performance in a plurality of different driving point environments. In this regard, in some embodiments, dimensions of the capacitively-coupled dual-band antenna disclosed herein can be adjusted to produce different resonant frequency responses with little change to the radiation patterns of the antenna. For example, in some embodiments, the capacitively-coupled dual-band antenna disclosed herein can produce a radiation pattern suitable for an embedded antenna deployed in a ceiling-mounted access point. Furthermore, in some embodiments, the capacitively-coupled dual-band antenna disclosed herein can be tuned to operate in a plurality of different frequency bands, and in some embodiments, the capacitively-coupled dual-band antenna disclosed herein can be used in connection with a plurality of wireless technologies, including BLE, LTE, UWB, Wi-Fi, and the like. For example, in some embodiments, the capacitively-coupled dual-band antenna disclosed herein can be tuned to have a 2:1 voltage standing wave ratio over a substantial bandwidth (>80%) with very little change to the radiation patterns of the antenna.

Figure 2:
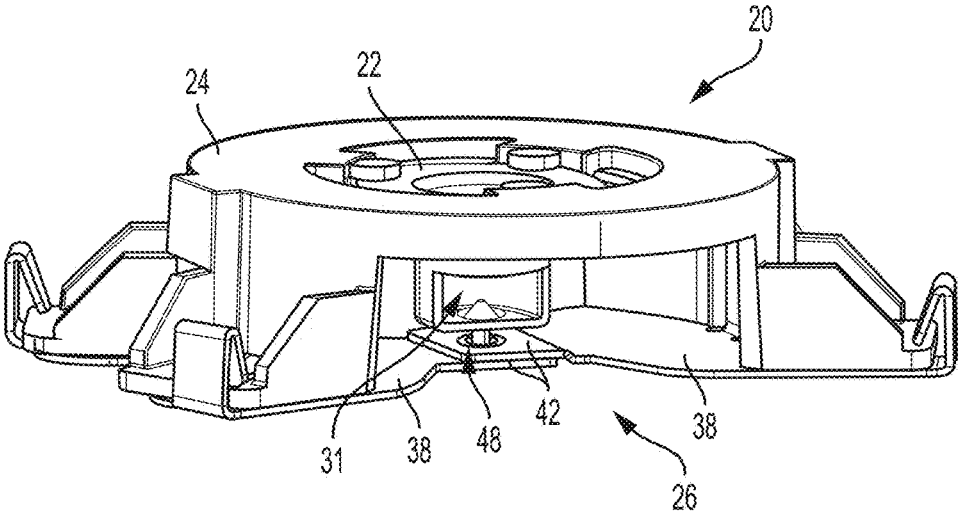
FIG. 2 is a perspective view of a capacitively-coupled dual-band antenna in accordance with disclosed embodiments.

FIG. 1 is an exploded view of a capacitively-coupled dual-band antenna 20 in accordance with disclosed embodiments and mounting hardware for the same, and FIG. 2 is a perspective view of the capacitively-coupled dual-band antenna 20. As seen, the capacitively-coupled dual-band antenna 20 can include a monopole antenna 22, a non-conductive frame 24, and a patch antenna 26, and the mounting hardware can include fasteners 28. The monopole antenna 22 can include a cylindrical bucket with an open top 30, a side window 31 formed in a side thereof, a feed hole 32 formed in a bottom thereof, and a lip 34 on a circumference of the open top 30. The patch antenna 26 can include an outer circular ring 36, a pair of feet 38, a pair of legs 40, a pair of overlapping tabs 42, a plurality of bent tabs 44, and an extruded hole 46. In some embodiments, the cylindrical bucket can be made of brass or some other easily drawn metal, the non-conductive frame 24 can be made of polycarbonate, nylon, or some other plastic having a dielectric constant of approximately 2.8-3, and the patch antenna 26 can be made of nickel silver, brass, or some other metal that is easily stamped to form the outer circular ring 36.

In some embodiments, the capacitively-coupled dual-band antenna 20 can be assembled as follows. The monopole antenna 22 can be heat-staked to the non-conductive frame 24 so that the non-conductive frame 24 physically supports the monopole antenna 22, and the non-conductive frame 24 as combined with the monopole antenna 22 can be placed over the outer circular ring 36 of the patch antenna 26 and held into place by the plurality of bent tabs 44, thereby capacitively coupling the monopole antenna 22 and the patch antenna 26. In this regard, the plurality of bent tabs 44 can ensure easy operator handling during assembly. Then, the monopole antenna 22, the non-conductive frame 24, and the patch antenna 26 can be placed in a fixture that guarantees tight alignment of feed and mounting holes, and a shield of a coaxial cable 48 can be soldered to at least one of the pair of overlapping tabs 42. For example, the extruded hole 46 can be centered in a bottom of one of the pair of overlapping tabs 42 and run through a center of a top of another one of the pair of overlapping tabs 42 to provide a surface (1) to which the shield of the coaxial cable 48 can be soldered and (2) that can guide a center conductor of the coaxial cable to the monopole antenna 22. Next, the center conductor of the coaxial cable 48 (e.g. the RF conductor) can be fed through the feed hole 32 and electrically coupled to the monopole antenna 22 by feeding solder into the open top 30 or the side window 31 of the cylindrical bucket while an iron heats an exterior of the cylindrical bucket to flow the solder. Finally, the capacitively-coupled dual-band antenna 20 can be fastened to a chassis and/or a ground plane using the fasteners 28 at attachment points on the capacitively-coupled dual-band antenna 20, for example, at pre-cut holes on the pair of feet 38 of the patch antenna 26 and on the non-conductive frame 24.

Various embodiments of the fasteners 28 are possible, including screws and nuts, pop rivets, or any other fastening device as would be known by one of ordinary skill in the art. In some embodiments, the fasteners 28 can attach the capacitively-coupled dual-band antenna 20 to the chassis and/or the ground plane from the top down or the bottom up.

In some embodiments, each of the monopole antenna 20 and the patch antenna 26 can be a respective radiating section of the capacitively-coupled dual-band antenna 20. For example, the center conductor of the coaxial cable 48 can be electrically coupled to the monopole antenna 20 and energized to supply current flow on the monopole antenna 22, which responsive thereto, can radiate a first signal in a 5 GHz (or high) frequency band. The monopole antenna 22 can be capacitively coupled to the patch antenna 26 and induce current flow on the patch antenna 26, which responsive thereto, can radiate a second signal in a 2.45 GHz (or low) frequency band.

In some embodiments, the monopole antenna 22 can form a resonant high frequency (e.g. 5 GHz) portion of the capacitively-coupled dual-band antenna 20. Furthermore, in some embodiments, the pair of legs 40 of the patch antenna 26 can form short circuits, can be displaced from the monopole antenna 22 by approximately a quarter wavelength at 5.5 GHz, and can be electrically shorter than a quarter wavelength at 5.5 GHz (in the z-dimension), thereby avoiding degradation of the inherent omnidirectionality of the monopole antenna 22 in the high frequency band. Further still, in some embodiments, the capacitively-coupled dual-band antenna 20 can include a capacitive gap that can extend from the lip 34 of the monopole antenna 22 to the outer circular ring 36 of the patch antenna 26. In some embodiments, a radial length of the capacitive gap to ground via one of the pair of legs 40 can be approximately a quarter wavelength at 5.5 GHz, thereby maintaining the necessary open circuit condition at the end of the monopole antenna 22.

In some embodiments, at 2.4 GHz (the low frequency band), the cylindrical bucket of the monopole antenna 22 can form an impedance transformer that can reduce the input impedance of the patch antenna 26 operating in the $TM_{20}$ radiation mode. Furthermore, in some embodiments, the capacitive gap between the lip 34 of the monopole antenna 22 and the outer circular ring 36 of the patch antenna 26 can be an impedance matching parameter that controls the input reactance. For example, dielectric loading within the capacitive gap can decrease gap reactance. In this regard, shaping the non-conductive frame 24 can impact low and high band resonant frequencies, the in-band Q factor of the low and high band resonances, and the overall impedance bandwidth of the capacitively-coupled dual-band antenna 20.

Figure 3:
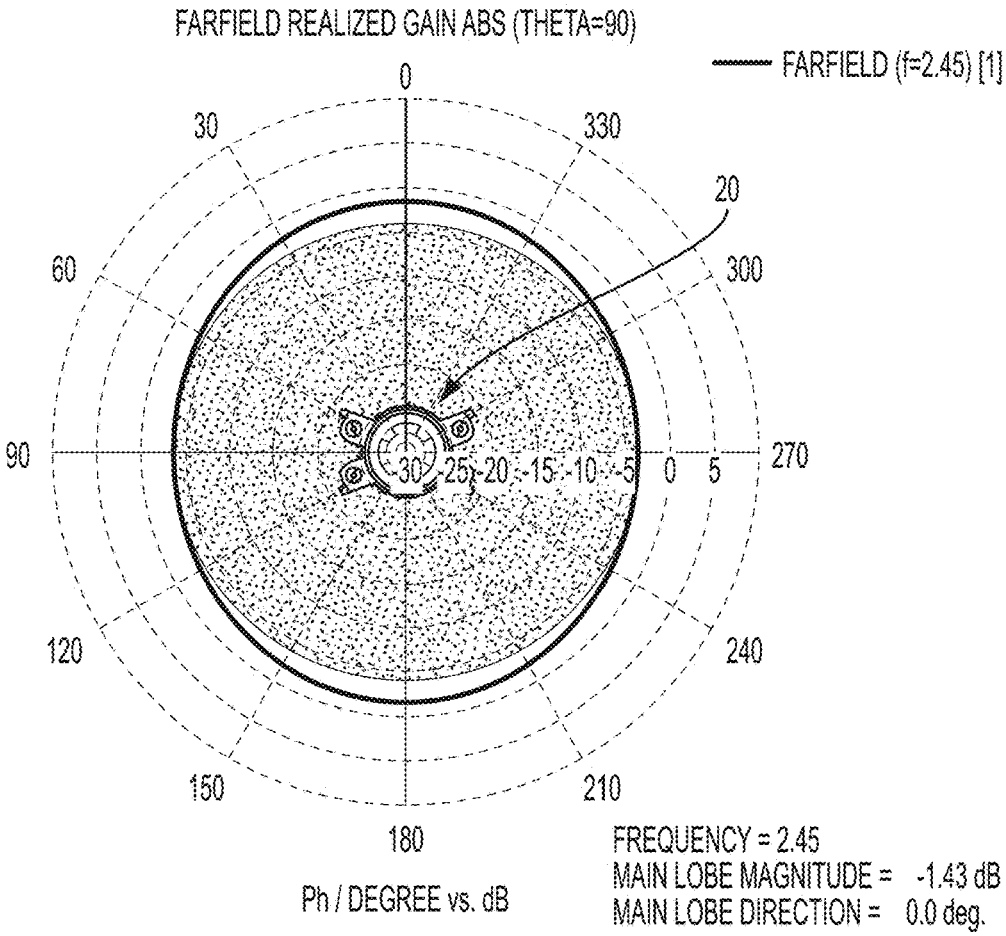
FIG. 3 is a graph of a simulated radiation pattern in the azimuth plane of a capacitively-coupled dual-band antenna operating at 2.45 GHz in accordance with disclosed embodiments.
Figure 4:
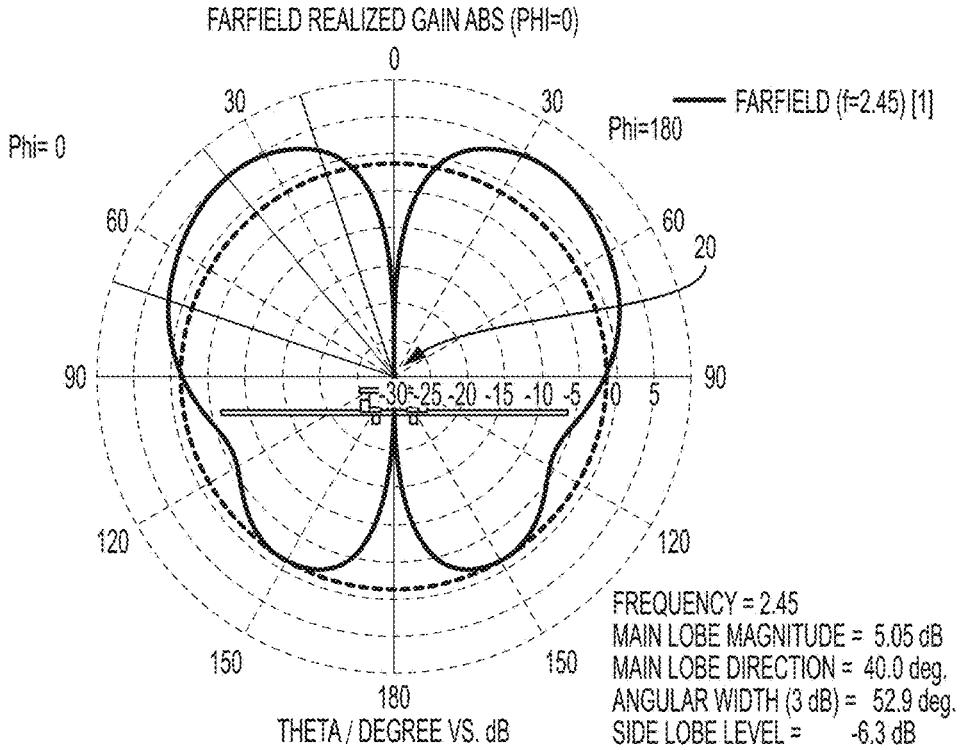
FIG. 4 is a graph of a simulated radiation pattern in the elevation plane of a capacitively-coupled dual-band antenna operating at 2.45 GHz in accordance with disclosed embodiments.
Figure 5:
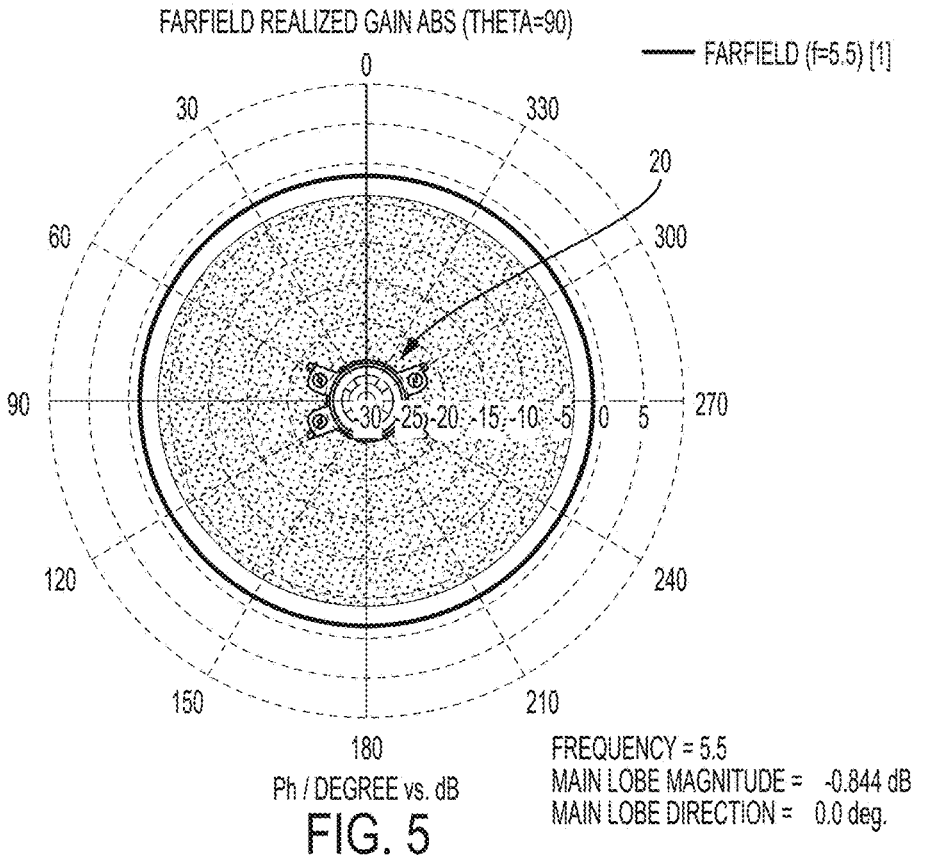
FIG. 5 is a graph of a simulated radiation pattern in the azimuth plane of a capacitively-coupled dual-band antenna operating at 5.5 GHz in accordance with disclosed embodiments.
Figure 6:
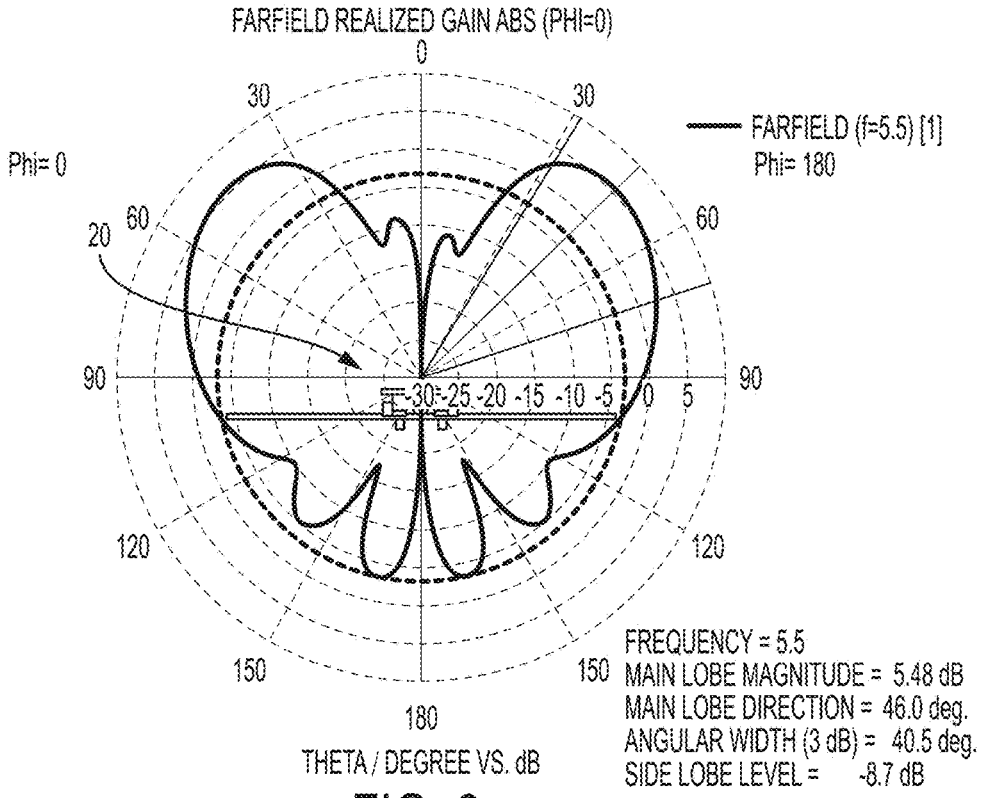
FIG. 6 is a graph of a simulated radiation pattern in the elevation plane of a capacitively-coupled dual-band antenna operating at 5.5 GHz in accordance with disclosed embodiments.

FIGS. 3-6 are graphs of simulated radiation patterns of the capacitively-coupled dual-band antenna 20 in accordance with disclosed embodiments. Specifically, FIG. 3 is a graph of a simulated radiation pattern in the azimuth plane of the capacitively-coupled dual-band antenna 20 operating at 2.45 GHz, FIG. 4 is a graph of a simulated radiation pattern in the elevation plane of the capacitively-coupled dual-band antenna 20 operating at 2.45 GHz, FIG. 5 is a graph of a simulated radiation pattern in the azimuth plane of the capacitively-coupled dual-band antenna 20 operating at 5.5 GHz, and FIG. 6 is a graph of a simulated radiation pattern in the elevation plane of the capacitively-coupled dual-band antenna 20 operating at 5.5 GHz. As seen, the radiation patterns are similar in both the high and low frequency bands and are ideal for an antenna in a ceiling-mounted access point.

Figure 7:
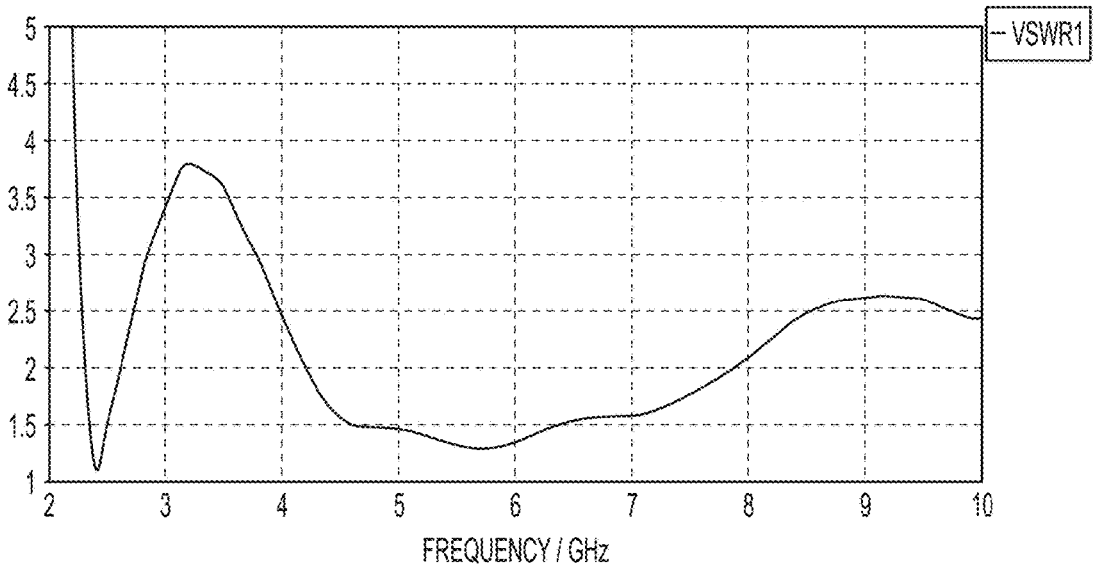
FIG. 7 is a graph of a simulated voltage standing wave ratio of a capacitively-coupled dual-band antenna in accordance with disclosed embodiments.
Figure 8:
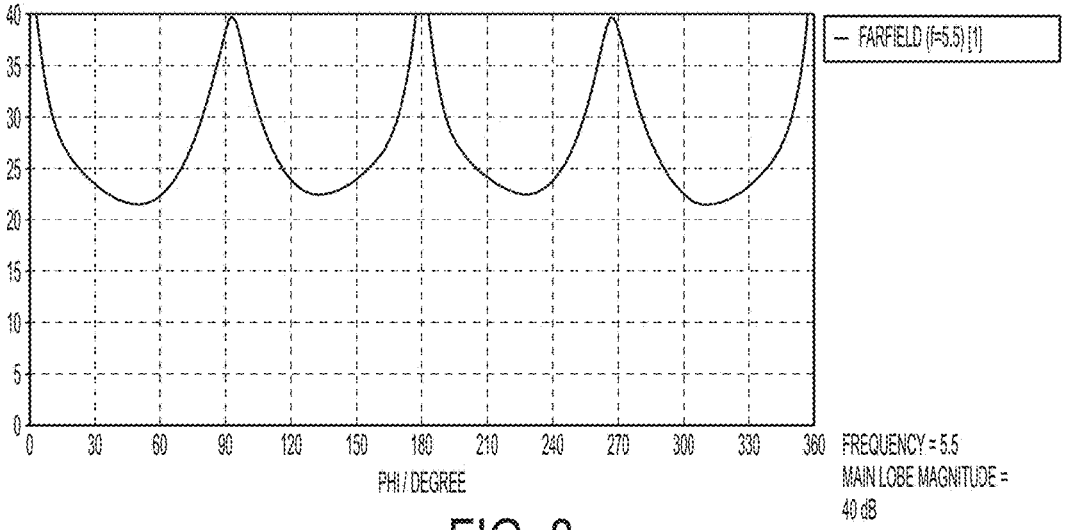
FIG. 8 is a graph of polarization discrimination in the azimuth plane of a capacitively-coupled dual-band antenna in accordance with disclosed embodiments.

FIG. 7 is a graph of a simulated voltage standing wave ratio of the capacitively-coupled dual-band antenna 20 in accordance with disclosed embodiments and demonstrates the dual-band nature of the capacitively-coupled dual-band antenna 20. FIG. 8 is a graph of polarization discrimination in the azimuth plane of the capacitively-coupled dual-band antenna 20 in accordance with disclosed embodiments. As seen, the high degree (>20 dB) of cross-polarization discrimination can allow for the capacitively-coupled dual-band antenna 20 to be collocated with and well-isolated from horizontally-polarized antenna elements within a single access point product.

Figure 9:
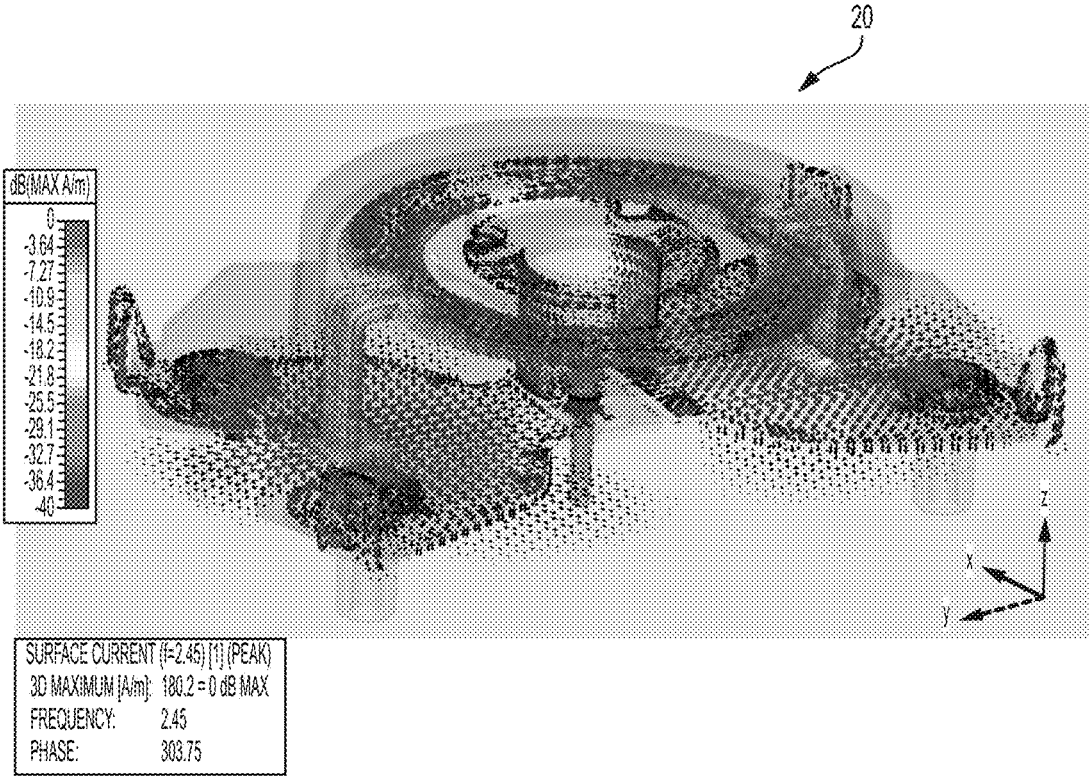
FIG. 9 is a graph illustrating the current distribution of a capacitively-coupled dual-band antenna operating at 2.45 GHz in accordance with disclosed embodiments.
Figure 10:
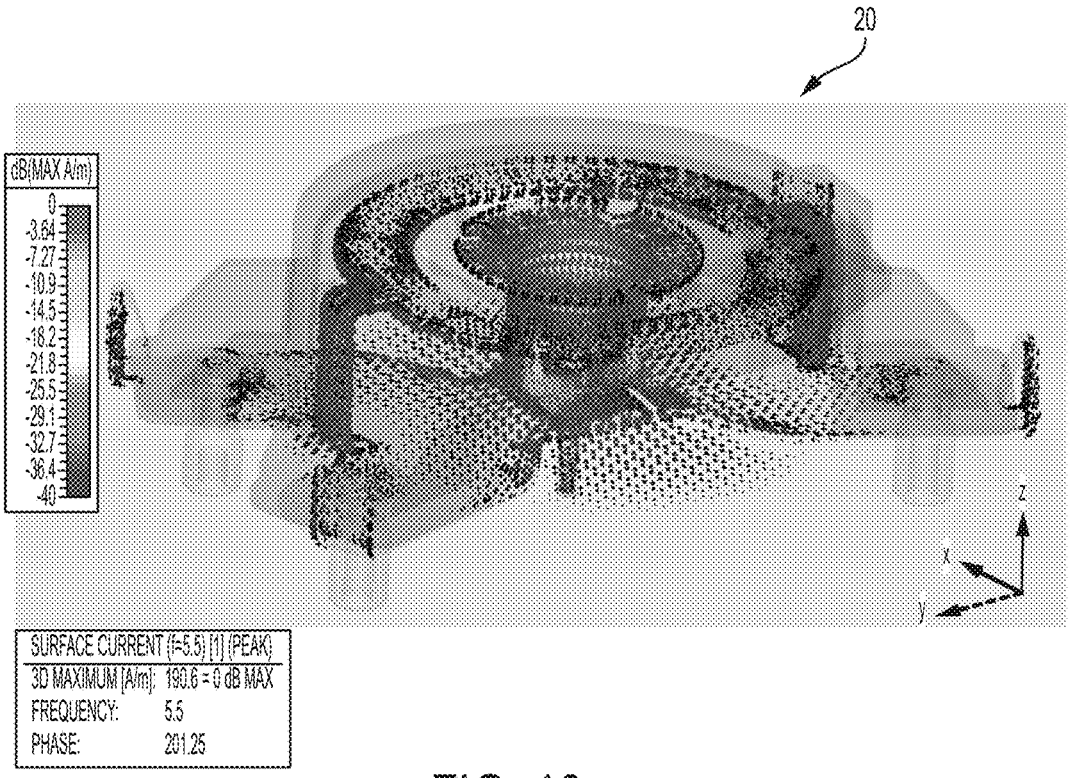
FIG. 10 is a graph illustrating the current distribution of a capacitively-coupled dual-band antenna operating at 5.5 GHz in accordance with disclosed embodiments.

FIG. 9 is a graph illustrating the current distribution (magnitude and direction) of the capacitively-coupled dual-band antenna 20 operating at 2.45 GHz in accordance with disclosed embodiments, and FIG. 10 is a graph illustrating the current distribution (magnitude and direction) of the capacitively-coupled dual-band antenna 20 operating at 5.5 GHz in accordance with disclosed embodiments. As seen, the high current points illustrate the resonant portions of the capacitively-coupled dual-band antenna 20 operating at a given frequency.

Figure 11:
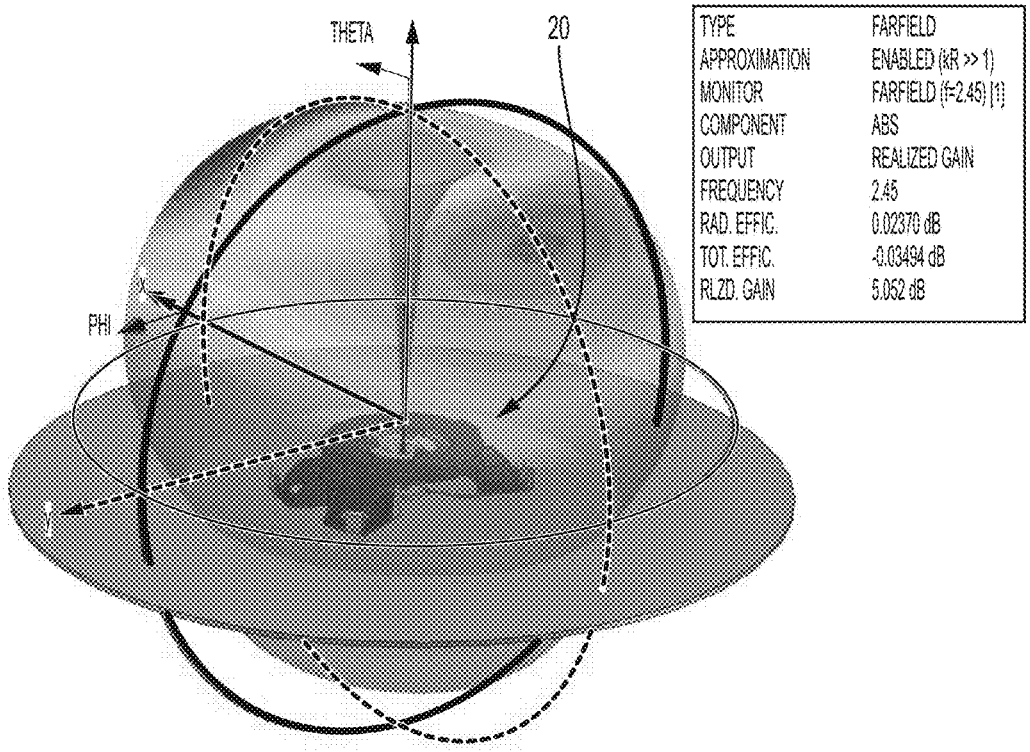
FIG. 11 is a graph illustrating a three-dimensional radiation pattern of a capacitively-coupled dual-band antenna operating at 2.45 GHz in accordance with disclosed embodiments.
Figure 12:
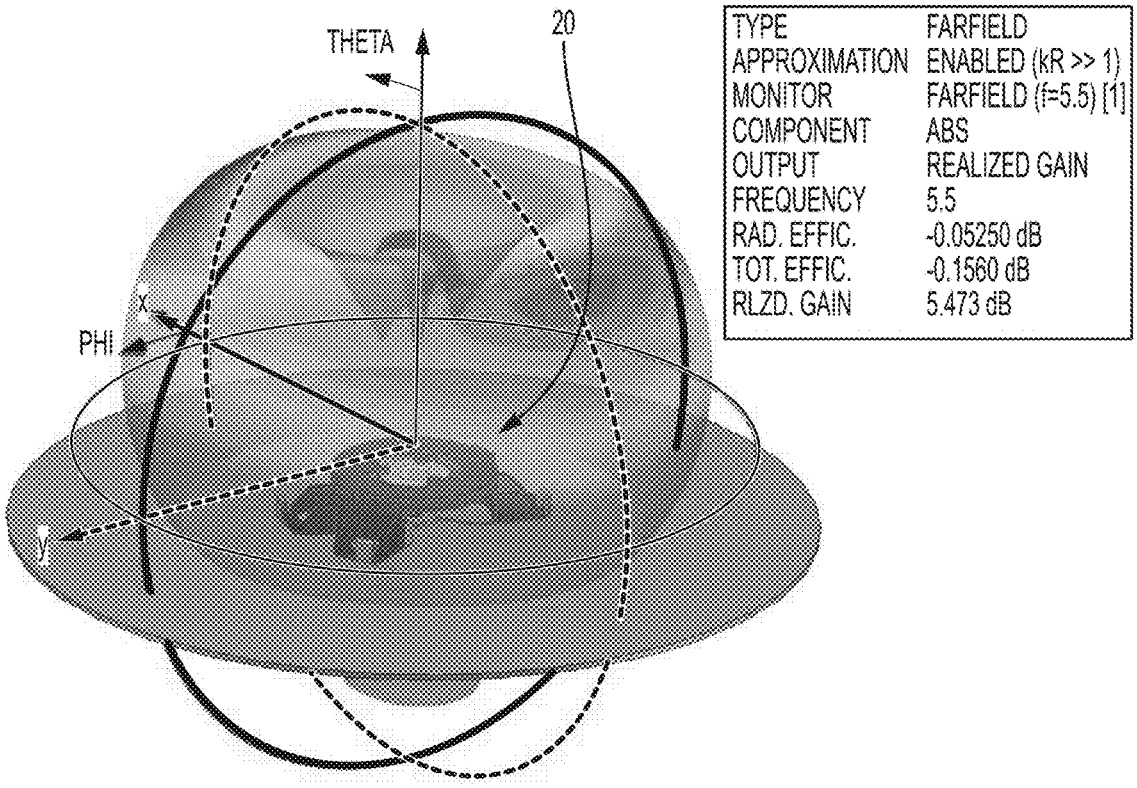
FIG. 12 is a graph illustrating a three-dimensional radiation pattern of a capacitively-coupled dual-band antenna operating at 5.5 GHz in accordance with disclosed embodiments.

FIG. 11 is a graph illustrating a three-dimensional radiation pattern of the capacitively-coupled dual-band antenna 20 operating at 2.45 GHz in accordance with disclosed embodiments, and FIG. 12 is a graph illustrating a three-dimensional radiation pattern of the capacitively-coupled dual-band antenna 20 operating at 5.5 GHz in accordance with disclosed embodiments. As seen, the radiation patterns are similar in both the high and low frequency bands and are ideal for an antenna embedded in a ceiling-mounted access point.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A dual-band antenna comprising:

a monopole antenna;

a patch antenna capacitively coupled to the monopole antenna; and a non-conductive frame that supports the monopole antenna and acts as a dielectric between the monopole antenna and the patch antenna, wherein the patch antenna includes an outer circular ring coupled to a pair of feet via a pair of legs, wherein the pair of feet include a pair of overlapping tabs that form an extruded hole, wherein a feed cable is fed through the extruded hole, and wherein a shield of the feed cable is terminated at at least one of the pair of overlapping tabs.

2. The dual-band antenna of claim 1 further comprising:

the feed cable, wherein a center conductor of the feed cable is electrically coupled to the monopole antenna.

3. The dual-band antenna of claim 1 further comprising:

a capacitive gap between a lip of the monopole antenna and the patch antenna, wherein a portion of the non-conductive frame fills the capacitive gap, and wherein a radial length of the capacitive gap to ground via a shorting leg of the patch antenna is approximately a quarter wavelength of an operating frequency of the monopole antenna.

4. The dual-band antenna of claim 1 wherein the monopole antenna radiates a first signal in a 5 GHz frequency band and the patch antenna radiates a second signal in a 2.4 GHz frequency band.

5. The dual-band antenna of claim 1 wherein the monopole antenna includes a cylindrical bucket having an open top, a side window, and a bottom, and wherein a center conductor of the feed cable is fed through a hole in the bottom of the cylindrical bucket and electrically coupled to the cylindrical bucket via solder deposited in the cylindrical bucket through the open top or the side window and heated from outside of the cylindrical bucket to flow the solder.

6. The dual-band antenna of claim 1 wherein the pair of legs form short circuits to enforce a $TM_{20}$ radiation mode and are displaced from the monopole antenna by approximately a quarter wavelength of an operating frequency of the monopole antenna.

7. The dual-band antenna of claim 1 further comprising:

a ground plane coupled to the patch antenna by a plurality of fasteners.

8. The dual-band antenna of claim 1 wherein the monopole antenna is made of brass, the patch antenna is made of nickel silver, and the non-conductive frame is made of polycarbonate.

9. A method comprising:

fitting a monopole antenna on a non-conductive frame;

placing the monopole antenna and the non-conductive frame over a patch antenna to capacitively couple the monopole antenna to the patch antenna via the non-conductive frame and air acting as a dielectric;

an outer circular ring of the patch antenna coupled to a pair of feet of the patch antenna via a pair of legs;

feeding a feed cable through an extruded hole formed in a pair of overlapping tabs on the pair of feet of the patch antenna; and terminating a shield of the feed cable at at least one of the pair of overlapping tabs.

10. The method of claim 9 further comprising:

electrically coupling a center conductor of the feed cable to the monopole antenna.

11. The method of claim 9 further comprising:

separating a lip of the monopole antenna from the patch antenna with a capacitive gap, wherein a portion of the non-conductive frame fills the capacitive gap, and wherein a radial length of the capacitive gap to ground via a shorting leg of the patch antenna is approximately a quarter wavelength of an operating frequency of the monopole antenna.

12. The method of claim 9 further comprising:

the feed cable electrically coupled to the monopole antenna energizing the monopole antenna to radiate a first signal in a 5 GHz frequency band; and the monopole antenna capacitively coupling with the patch antenna to energize the patch antenna to radiate a second signal in a 2.4 GHz frequency band.

13. The method of claim 9 further comprising:

feeding a center conductor of the feed cable through a hole in a bottom of a cylindrical bucket of the monopole antenna; and electrically coupling the center conductor of the feed cable to the cylindrical bucket via solder deposited in the cylindrical bucket through an open top or a side window of the cylinder and heated from outside of the cylindrical bucket to flow the solder.

14. The method of claim 9 further comprising:

the pair of legs forming short circuits to enforce a $TM_{20}$ radiation mode; and displacing the pair of legs from the monopole antenna by approximately a quarter wavelength of an operating frequency of the monopole antenna.

15. The method of claim 9 further comprising:

coupling a ground plane to the patch antenna by a plurality of fasteners.

16. The method of claim 9 wherein the monopole antenna is made of brass, the patch antenna is made of nickel silver, and the non-conductive frame is made of polycarbonate.

* * * * *